US010617236B2

(12) United States Patent
Bacallao et al.

(10) Patent No.: US 10,617,236 B2
(45) Date of Patent: Apr. 14, 2020

(54) BAGGING STATION WITH SHOPPING BAG HOLDER

(71) Applicant: Walmart Apollo, LLC, Bentonville, AR (US)

(72) Inventors: Yurgis Mauro Bacallao, Centerton, AR (US); Carolyne Wendel, Pea Ridge, AR (US)

(73) Assignee: WALMART APOLLO, LLC, Bentonville, AR (US)

( * ) Notice: Subject to any disclaimer, the term of this patent is extended or adjusted under 35 U.S.C. 154(b) by 0 days.

(21) Appl. No.: 16/390,295

(22) Filed: Apr. 22, 2019

(65) Prior Publication Data

US 2019/0357705 A1 Nov. 28, 2019

Related U.S. Application Data

(60) Provisional application No. 62/676,491, filed on May 25, 2018.

(51) Int. Cl.
*A47F 9/04* (2006.01)
*B65B 67/12* (2006.01)
(Continued)

(52) U.S. Cl.
CPC ..... *A47F 9/042* (2013.01); *A47B 49/00* (2013.01); *A47F 13/085* (2013.01); *B65B 67/1233* (2013.01)

(58) Field of Classification Search
CPC ..... A47F 9/042; A47F 9/043; A47F 9/045; A47F 13/085; A47F 5/0006; A47F 5/08;
(Continued)

(56) References Cited

U.S. PATENT DOCUMENTS 94,016 A * 8/1869 Mayo et al. ..... A47F 3/005 312/139.2
228,627 A * 6/1880 Gordon ..... A47F 3/005 312/114
(Continued)

FOREIGN PATENT DOCUMENTS

JP 6096712 B2 3/2017
WO 2006130911 A1 12/2006

OTHER PUBLICATIONS

100mm metal wire clip/clipboard clip, Dongguan Taoyuan Stationary Co., Ltd., Sell.Lulusoso.com, accessed May 20, 2016; 4 pages.
(Continued)

*Primary Examiner* — Jennifer E. Novosad
(74) *Attorney, Agent, or Firm* — Schmeiser, Olsen & Watts LLP; Karen E. Jachimowicz

(57) ABSTRACT

A bagging station with a bag holder includes a box that encloses a bag dispenser. The bag holder is mounted at a bagging station in a retail store so the bag dispenser can hold and dispense shopping bags at the bagging station. The bag holder includes a rectangular box with a sliding door front that encases the bag dispenser and the shopping bags. The sliding door slides between a closed position and an open position. In the open position, the bag dispenser is accessible at the bagging station, and is used to dispense shopping bags. In the closed position, the bag dispenser and the shopping bags are enclosed in the bag holder. In the closed position, the shopping bags will not fall off the bag dispenser, or be stolen from the bag dispenser.

17 Claims, 8 Drawing Sheets

(51) Int. Cl.
*A47B 49/00* (2006.01)
*A47F 13/08* (2006.01)

(58) Field of Classification Search
CPC ... A47F 7/03; A47F 5/05; B65B 67/12; B65B 67/1205; B65B 67/1216; B65B 2067/1261; B65B 2067/1294; B65B 67/1211; B65B 67/1227; B65B 67/1266; B65B 67/1233; A47G 23/0258; A47B 17/04; A47B 49/00; A47B 49/004; A47B 2063/005; E06B 3/5045; E06B 5/006; E06B 9/115; E06B 9/15; F16B 1/00; F16B 2001/0035
USPC ..... 211/85.15, 12, 163; 312/297, 139.2; 160/37; 248/95; 186/66, 67
See application file for complete search history.

(56) References Cited

U.S. PATENT DOCUMENTS 473,099 A 4/1892 Vincentz
636,491 A * 11/1899 Cohen ..... A47B 88/48 312/307
721,996 A 3/1903 Bunnell
743,547 A 11/1903 Nix
1,355,643 A 10/1920 Bausan et al.
1,754,327 A 4/1930 Leonard
1,845,385 A * 2/1932 Zelenka ..... A47F 3/125 312/114
2,107,997 A * 2/1938 Horsley ..... B65D 43/20 312/297
2,324,596 A 7/1943 Quain
2,521,604 A 9/1950 Provost
2,616,133 A 11/1952 Peters
2,722,469 A * 11/1955 Kosovsky ..... G07D 11/12 312/310
2,766,822 A * 10/1956 Potter ..... F25D 23/021 160/201
3,055,508 A 9/1962 Reeser
3,175,793 A 3/1965 Kennedy
3,262,579 A 7/1966 Reich
3,294,465 A * 12/1966 Blodee ..... E06B 9/115 312/297
3,424,421 A 1/1969 Kalbow
3,434,686 A 3/1969 Yoshizaburo
3,628,632 A 12/1971 Lambert
3,679,096 A * 7/1972 Musser ..... A47F 9/042 221/56
3,747,298 A 7/1973 Lieberman
3,838,839 A 10/1974 Spencer
3,847,332 A 11/1974 Murai
4,062,170 A * 12/1977 Orem ..... B65B 67/1266 53/390
4,085,822 A * 4/1978 Osborn ..... A47F 9/042 186/66
4,094,415 A 6/1978 Larson
4,106,733 A 8/1978 Walitalo
4,106,734 A 8/1978 Ivalitalo
4,143,845 A 3/1979 Harris
4,155,458 A * 5/1979 Moline ..... B25H 3/04 211/4
4,171,150 A * 10/1979 Soderlund ..... A47B 47/042 312/107
4,217,012 A * 8/1980 Klaus ..... A47B 55/06 312/111
4,289,242 A 9/1981 Kenyon
4,398,689 A 8/1983 Prader
4,498,652 A 2/1985 Malik
4,600,254 A * 7/1986 Whalen ..... E05D 15/582 312/110
4,657,318 A * 4/1987 Strange ..... E06B 9/115 160/201
4,696,522 A * 9/1987 Lowe ..... E06B 9/115 312/223.2
4,771,966 A 9/1988 Anderson
4,785,971 A * 11/1988 Konarik ..... A47F 13/085 221/282
4,793,665 A * 12/1988 King ..... A47F 5/0043 211/40
4,826,022 A 5/1989 Duarte
RE33,122 E 12/1989 Orem
5,012,994 A 5/1991 Keefe
5,054,728 A 10/1991 Nigro, Jr.
5,131,499 A * 7/1992 Hoar ..... B65B 67/04 186/66
5,184,728 A * 2/1993 Wile ..... A47F 13/085 206/493
5,255,970 A * 10/1993 Theosabrata ..... A47B 81/067 312/107
5,269,416 A * 12/1993 DeMatteis ..... A47F 9/042 211/50
5,295,743 A * 3/1994 Moulton ..... A47B 96/00 160/236
5,399,010 A * 3/1995 McClung ..... E06B 3/5045 312/322
5,407,170 A 4/1995 Slivon et al.
5,462,178 A 10/1995 Wallach et al.
5,467,572 A 11/1995 Wile et al.
5,524,979 A * 6/1996 Carson ..... E05D 15/582 312/319.2
5,632,409 A * 5/1997 Raghunanan ..... A47K 10/425 221/45
5,803,563 A * 9/1998 Woodward ..... E06B 9/115 160/37
5,885,002 A 3/1999 Reiss
5,964,060 A 10/1999 Furlong
6,474,478 B1 11/2002 Huehner et al.
6,491,218 B2 12/2002 Nguyen
6,550,583 B1 4/2003 Brenhouse
6,622,979 B2 9/2003 Valiulis
7,114,650 B2 10/2006 Sherrod
7,172,092 B2 * 2/2007 Yang ..... A47F 9/042 206/449
7,516,820 B1 4/2009 Cox et al.
7,753,588 B2 7/2010 Bazbaz
7,784,625 B2 * 8/2010 Burgess ..... A47B 46/005 211/85.15
7,866,546 B1 1/2011 Vance
7,882,964 B2 2/2011 Battaglia
D665,193 S * 8/2012 Huffey ..... D6/666
8,256,644 B2 * 9/2012 Orgna ..... A47K 5/1202 221/45
8,359,722 B2 1/2013 Polizzi
8,400,324 B1 3/2013 Jaeger
8,584,982 B2 11/2013 Eakin
8,678,281 B2 3/2014 Kangas et al.
8,707,626 B2 4/2014 Martin
9,101,232 B1 8/2015 Newman
9,622,598 B1 * 4/2017 Davis, Jr. ..... A47F 9/042
9,622,599 B2 4/2017 Davis, Jr.
9,750,356 B2 9/2017 Tan
9,770,123 B2 9/2017 Tan
10,028,598 B2 * 7/2018 Bacallao ..... B65B 67/1233
10,029,815 B2 * 7/2018 Robinson ..... B65B 67/1227
10,106,284 B2 * 10/2018 Bacallao ..... A47F 5/01
2002/0000504 A1 1/2002 Bayne
2003/0168378 A1 * 9/2003 Au ..... A45C 11/10 206/736
2004/0112850 A1 6/2004 Jordan
2005/0114216 A1 5/2005 Lantz et al.
2005/0258177 A1 11/2005 Woodson
2006/0021956 A1 * 2/2006 Wilfong, Jr. ..... A47F 9/042 211/59.1
2007/0176058 A1 * 8/2007 Kohn ..... A47F 9/042 248/100
2007/0181753 A1 8/2007 Herlands
2009/0206091 A1 * 8/2009 Hoffmann ..... A47F 9/042 220/553
2009/0289019 A1 11/2009 Alvarado et al.
2010/0012793 A1 1/2010 Sung
2010/0021088 A1 1/2010 Wilfong, Jr.
2010/0096514 A1 4/2010 Adair et al.

(56) References Cited

U.S. PATENT DOCUMENTS

| | | | | |
|---|---|---|---|---|
| 2010/0148019 | A1 | 6/2010 | Simhaee | |
| 2010/0314507 | A1 | 12/2010 | Laitila et al. | |
| 2011/0266092 | A1 | 11/2011 | Marquis et al. | |
| 2012/0118839 | A1* | 5/2012 | Tan | A47F 9/042 211/59.2 |
| 2013/0223766 | A1 | 8/2013 | Gebhardt | |
| 2013/0259405 | A1 | 10/2013 | Jack | |
| 2013/0284756 | A1* | 10/2013 | Springer | B65D 83/08 221/34 |
| 2014/0138499 | A1 | 5/2014 | Laitila et al. | |
| 2015/0048039 | A1 | 2/2015 | Laitila et al. | |
| 2017/0020307 | A1 | 1/2017 | Davis, Jr. | |
| 2017/0055727 | A1* | 3/2017 | Tan | A47F 13/085 |
| 2017/0217621 | A1 | 8/2017 | Robinson et al. | |
| 2017/0280900 | A1 | 10/2017 | Bacallao | |
| 2017/0325603 | A1 | 11/2017 | Bacallao | |
| 2017/0354274 | A1 | 12/2017 | Bacallao | |
| 2018/0049565 | A1 | 2/2018 | Bacallao | |
| 2018/0064266 | A1 | 3/2018 | Bacallao et al. | |
| 2018/0065770 | A1 | 3/2018 | Bacallao et al. | |
| 2018/0170597 | A1 | 6/2018 | Bacallao | |
| 2019/0127103 | A1 | 5/2019 | Bacallao et al. | |
| 2019/0231096 | A1* | 8/2019 | Bacallao | A47F 9/042 |
| 2019/0357705 | A1* | 11/2019 | Bacallao | B65B 67/1233 |

OTHER PUBLICATIONS

Over Door Bag Holder Waste Bin, Hang Over Kitchen Door, Reuses Shopping Bags, Klife, Ebay.com, on May 23, 2016; 4 pages.

Web page image 1, Dec. 29, 2015, https://www.google.co.in/imgres?imgurl=https://c1.staticflickr.com/3/2932/14248018844_89e3d89fa4_b.jpg&imgrefurl=https://www.flickr.com/photos/ieepersmedia/14248018844&h=950&w=1024&tbnid=MyLI_TOn6HIMCM:&docid=9feoV3Exk3O-4M&ei=jfyAVsbyJMPluASeoa6QBw&tbm=isch&ved=0ahUKEwiG7Z7tmv7JAhVDJI4KHZ6QC3IQMwgkKAkwCQ.

Web page image 2, Dec. 29, 2015, https://www.flickr.com/photos/fourstarcashiernathan/6979145827.

Weimaamerica, "Carousel Bagging System for WEIMA Briquette Press," YouTube.com, Apr. 15, 2009. Video.

Non-Final Office Action in U.S. Appl. No. 15/415,026, dated Dec. 28, 2017; 8 pages.

Notice of Allowance in U.S. Appl. No. 15/415,026 dated May 21, 2018; 6 pages.

Non-Final Office Action for U.S. Appl. No. 15/695,306, dated Apr. 18, 2018; 11 pages.

Notice of Allowance for U.S. Appl. No. 15/695,306, dated Jul. 23, 2018; 7 pages.

Non-Final Office Action in U.S. Appl. No. 15/695,401, dated Feb. 2, 2018; 7 pages.

Notice of Allowance for U.S. Appl. No. 15/695,401, dated May 4, 2018; 8 pages.

Non-Final Office Action in U.S. Appl. No. 16/143,800 dated Dec. 11, 2019; 6 pages.

Non-Final Office Action in U.S. Appl. No. 16/390,277 dated Sep. 24, 2019; 14 pages.

Notice of Allowance in U.S. Appl. No. 16/390,277, dated Jan. 15, 2020; 5 pages.

Notice of Allowance in U.S. Appl. No. 16/143,800 dated Feb. 13, 2020; 9 pages.

* cited by examiner

BAGGING STATION WITH SHOPPING BAG HOLDER

CROSS REFERENCE TO RELATED APPLICATION

This invention claims priority to U.S. provisional patent application Ser. No. 62/676,491, filed May 25, 2018, and entitled "Bagging Station with Shopping Bag Holder", which is incorporated entirely herein by reference.

BACKGROUND OF THE INVENTION

Technical Field

This invention relates to bagging stations in retail stores where purchases are loaded into shopping bags, and specifically to a bagging station with a bag holder for encasing the shopping bags.

State of the Art

A bagging station is a fixture in a retail store where purchased items are loaded into bags so the items can be carried out of the store by the customer. Bagging stations are often located at checkout registers where purchased items are paid for. Bagging stations are designed to store and dispense bags, often plastic shopping bags. Bagging stations include bag dispensers that hold and dispense the plastic shopping bags. However, bag dispensers often hold the shopping bags with no covering, which can look messy and can lead to bags falling off the dispensers or getting stolen from the bag dispensers.

Accordingly, what is needed is a bagging station that includes a bag holder that encases the shopping bags at the bagging station.

DETAILED DESCRIPTION OF EMBODIMENTS OF THE INVENTION

As discussed above, embodiments of the invention relate to bagging stations in retail stores where purchases are loaded into shopping bags, and specifically to a bagging station with a bag holder for encasing the shopping bags.

A bagging station is a fixture in a retail store where purchased items are loaded into shopping bags so the items can be carried out of the store by the customer. Bagging stations are often at checkout registers where purchased items are paid for. Bagging stations are usually designed to store and dispense plastic bags. The bagging station for plastic bags will often have a bag dispenser with hooks and arms for holding stacks of plastic bags, and for hanging plastic bag arms from, to keep the plastic bag open while filling. The bag dispensers are often mounted to center sections that set on a rotating platform to create a carousel-type bagging station. The rotating platform has a number of bag dispensers, which are rotated as bags are filled to make loading and removing shopping bags efficient and easy. However, the bag dispensers are not covered, which can lead to a mess if shopping bags fall off the bag dispenser. In addition, bags are sometimes stolen from the bag dispenser because it is easy to grab a stack of shopping bags from the bag dispenser. What is needed is a bag holder for a bagging station that encases the shopping bags and yet is still easy to use and dispense shopping bags.

Disclosed is a bagging station for a retail store that includes a center section and at least one bag holder coupled to the center section. The center section sets on a rotating platform and holds a number of bag holders with bag dispensers. The center section rotates to so that access to each bag holder and bag dispenser is convenient. Each bag holder has a bag dispenser encased in a rectangular shaped box. The bag dispenser holds and dispenses shopping bags. The rectangular shaped box holds the bag dispenser and the shopping bags hung on the bag dispenser. The box has an open front that can be covered by a sliding door. The sliding door is flexible and slides between an open position and a closed position. In the closed position the sliding door covers the open front. In the open position the sliding door does not cover the open front, but slides out of the way and retracts into the rectangular shaped box. With the sliding door in the open position, the shopping bags hanging from the bag dispenser are easily accessible and can be filled with products and dispensed. With the sliding door in the closed position, the bag dispenser and the shopping bags hanging from the bag dispenser are encased in the rectangular box and are not easily accessible. Shopping bags are protected from falling off or being wrongly removed from the bag dispenser when the sliding door is in the closed position.

Figure 1:
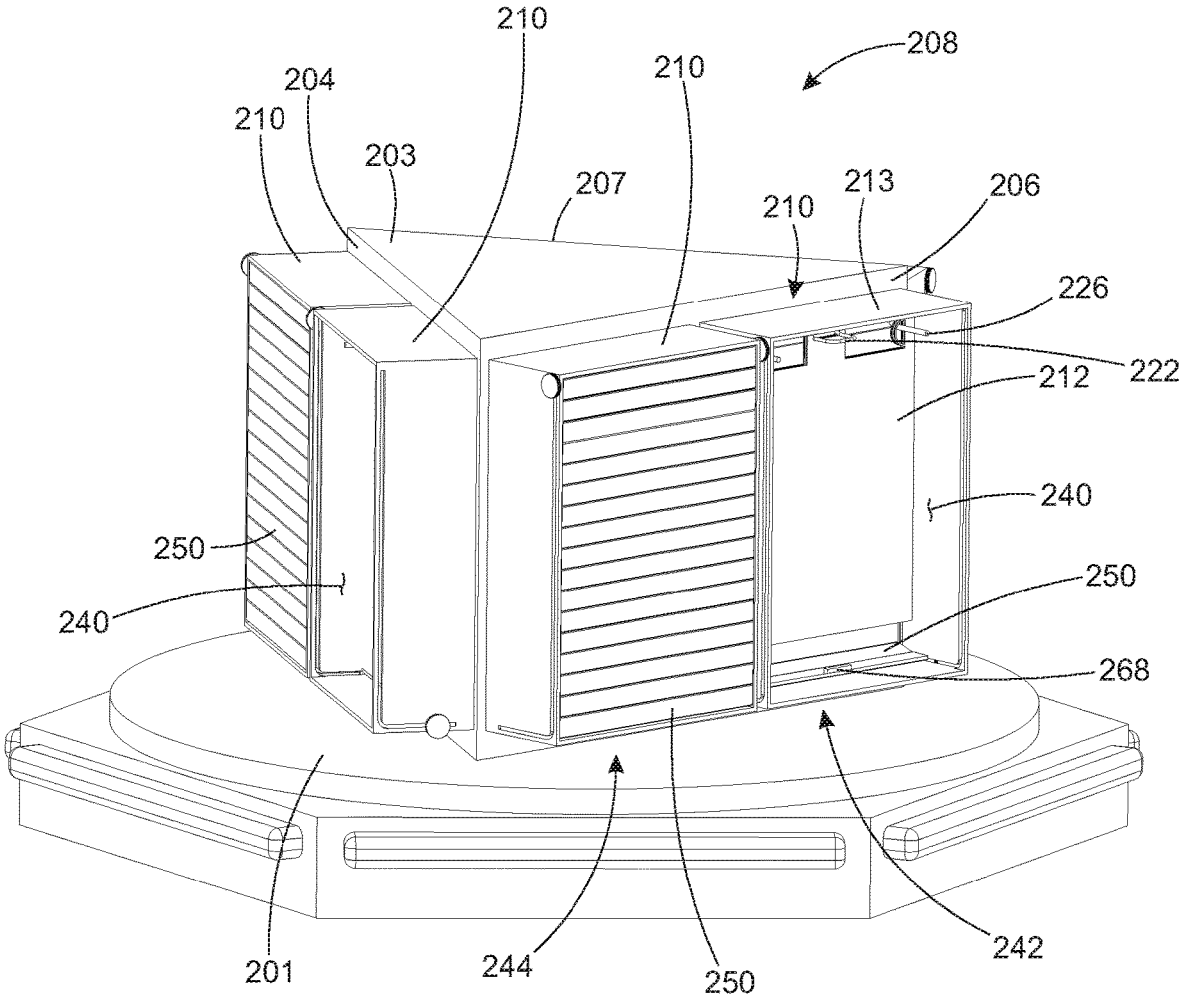
FIG. 1 shows a front perspective view of a bagging station for a retail store with several bag holders.
Figure 2:
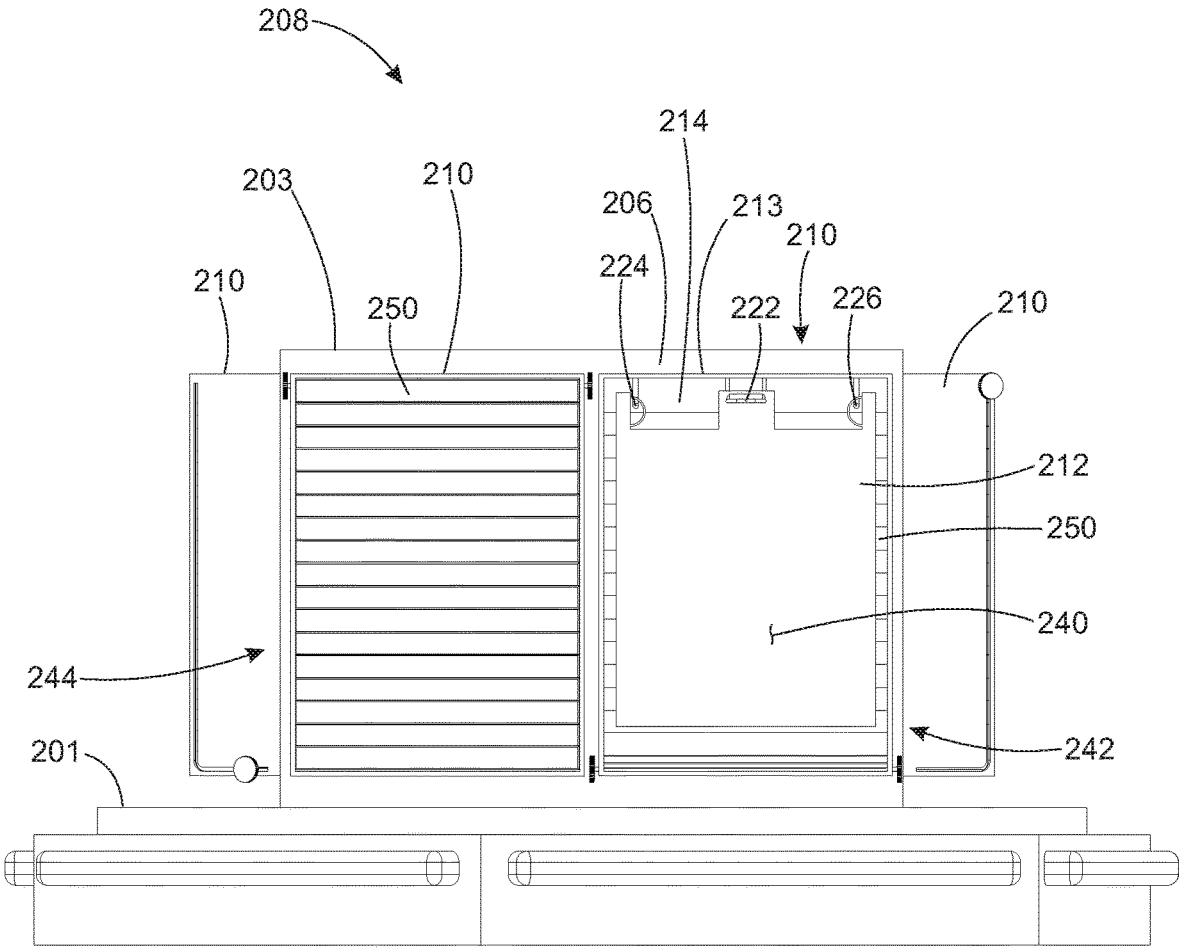
FIG. 2 shows a side view the of the bagging station of FIG. 1.
Figure 3:
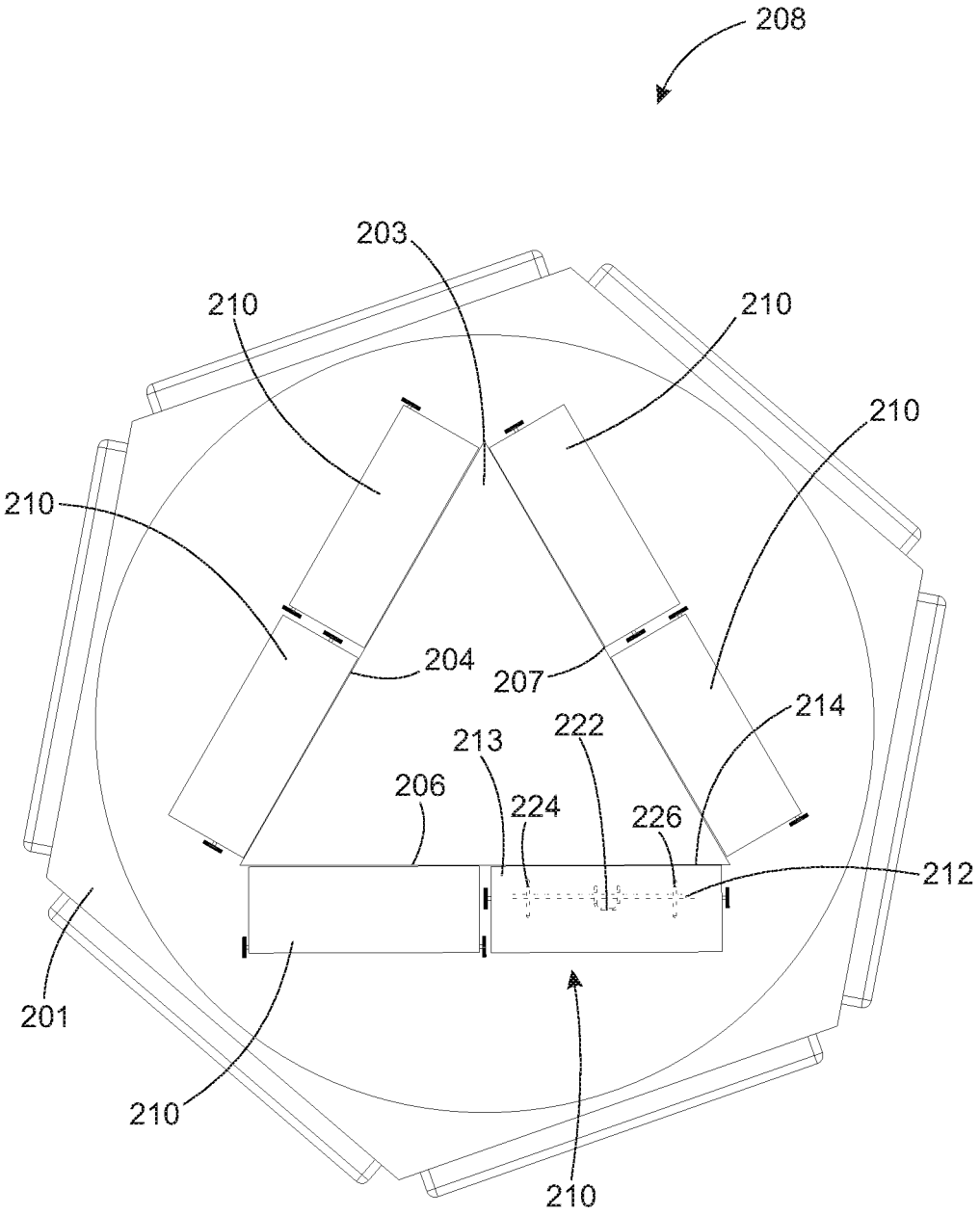
FIG. 3 shows a top view of the bagging station of FIG. 1.

FIG. 1 through FIG. 3 shows a bagging station 208 for a retail store. Bagging station 208 includes a number of bag holders 210 that each hold at least one shopping bag 212. Bagging station 208 includes a center section 203 that sets on a rotating platform 201. Center section 203 is triangular shaped in top view in this embodiment (see FIG. 3), with three solid center section side walls 204, 206, and 207. Each of side walls 204, 206, and 207 have two bag holders 210 coupled to it, where each bag holder 210 holds at least one shopping bag 212. FIG. 1 shows a front perspective view of bagging station 208 showing two bag holders 210 coupled to each of center section side walls 204 and 206. FIG. 2 shows a side view of bagging station 208, showing two bag holders 210 coupled to center section side wall 206. In the embodiment shown in FIG. 2, one bag holder 210 has a sliding door 250 in a closed position 244, and the other bag holder 210 has a sliding door 250 in an open position 242. FIG. 3 shows a top view of bagging station 208 with two bag holders 210 coupled to each of center section side walls 204, 206, and 207. Center section 203 rotates with rotating platform 201 so that each bag holder 210 can be conveniently accessed by a cashier or customer. Each bag holder 210 holds and dispenses shopping bags 212. When sliding door 250 is in open position 242, shopping bags 212 can be accessed, filled and removed from bag holder 210. When sliding door 250 is in closed position 244, shopping bags 212 cannot be accessed and are safe from theft or from falling out of bag holder 210. Bagging station 208, in the embodiment shown in the figures, includes six bag holders 210, two on each of center section side walls 204, 206, and 207, but this is not meant to be limiting. Bagging station 208 can include any number of bag holders 210.

Figure 4:
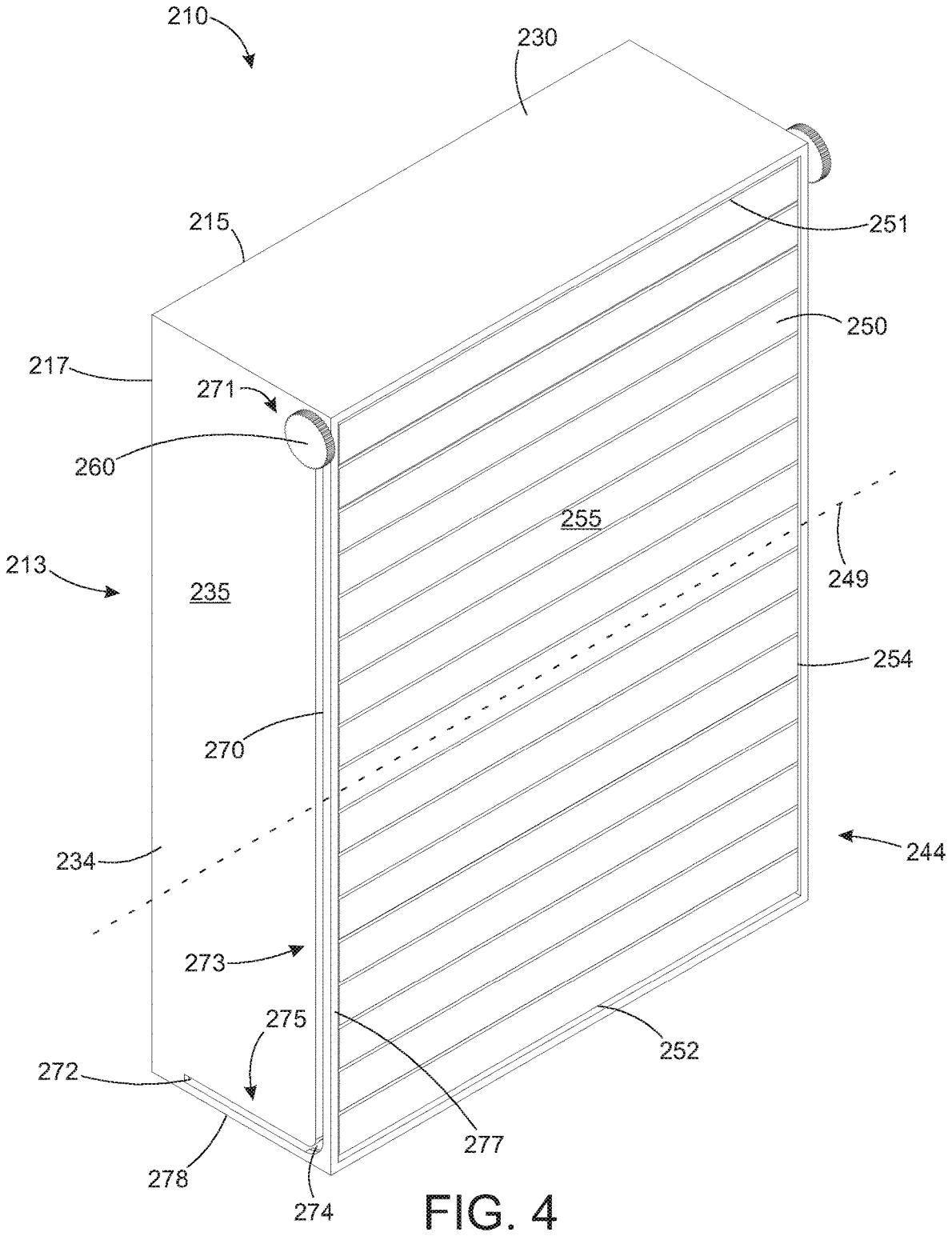
FIG. 4 shows a front perspective view of a bag holder for holding at least one shopping bag, with a sliding door of the bag holder in the closed position.
Figure 5:
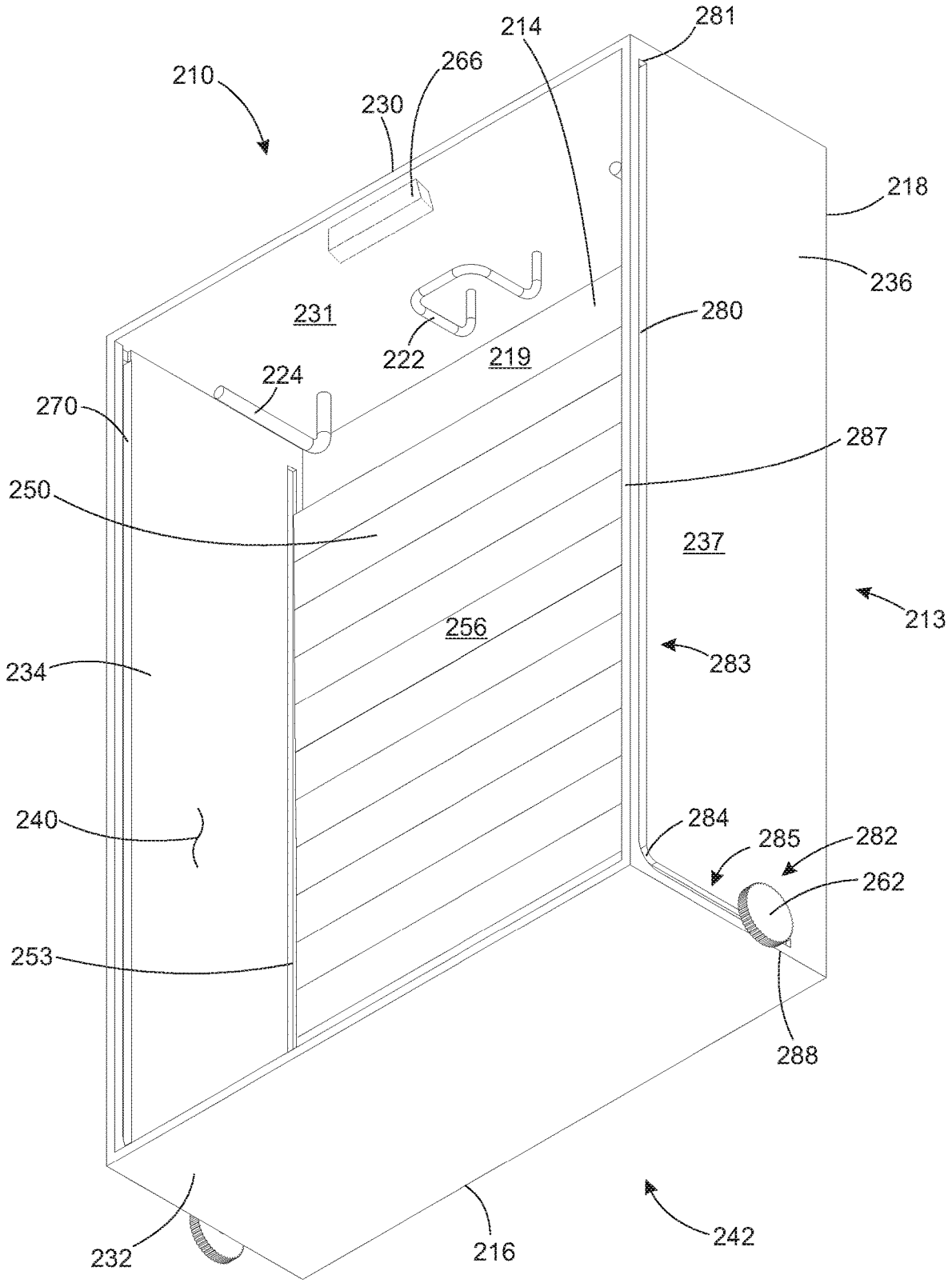
FIG. 5 shows a bottom perspective view of the bag holder of FIG. 4, with a sliding door of the bag holder in the open position.
Figure 6:
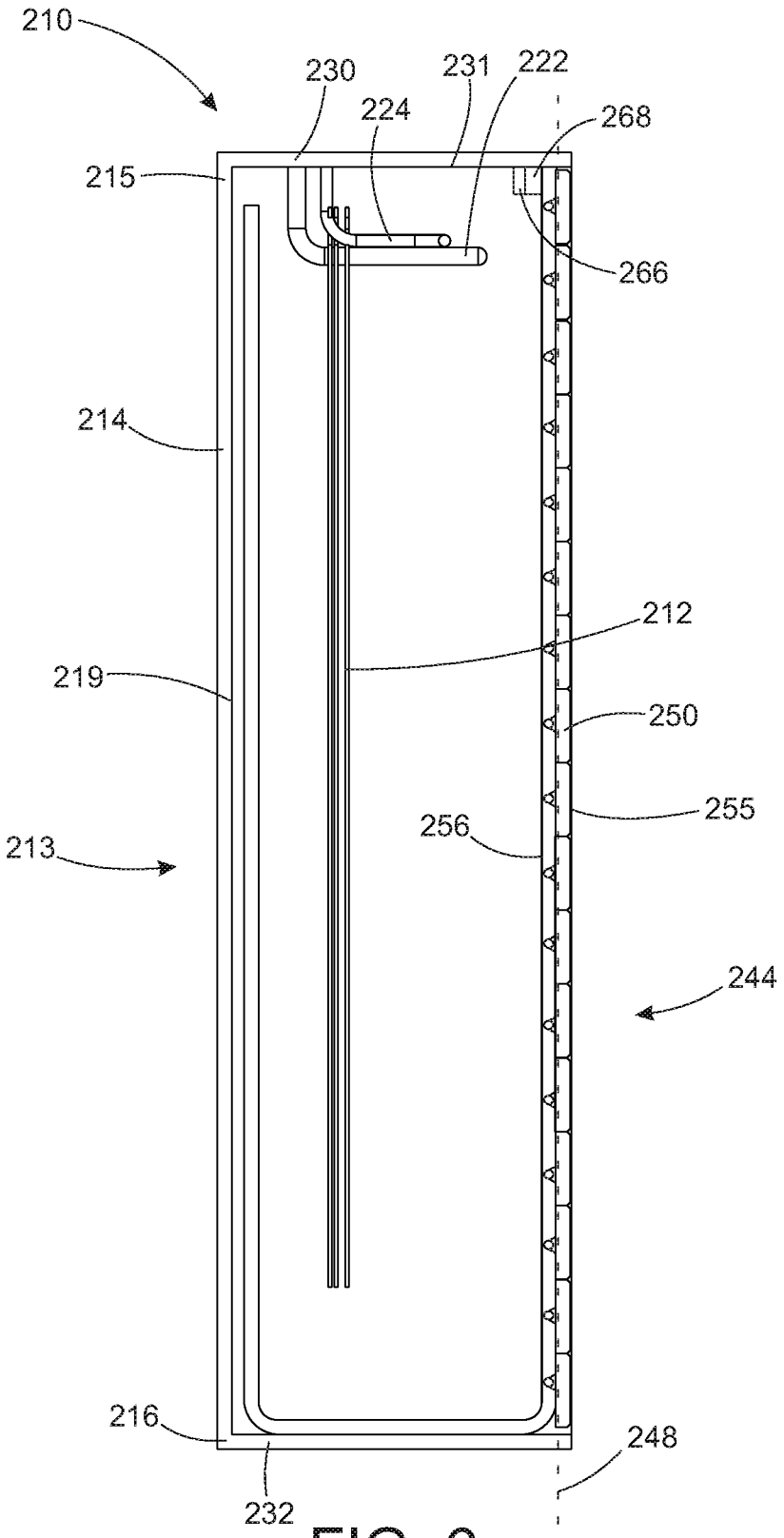
FIG. 6 shows a side cross-section view of the bag holder of FIG. 4.
Figure 7:
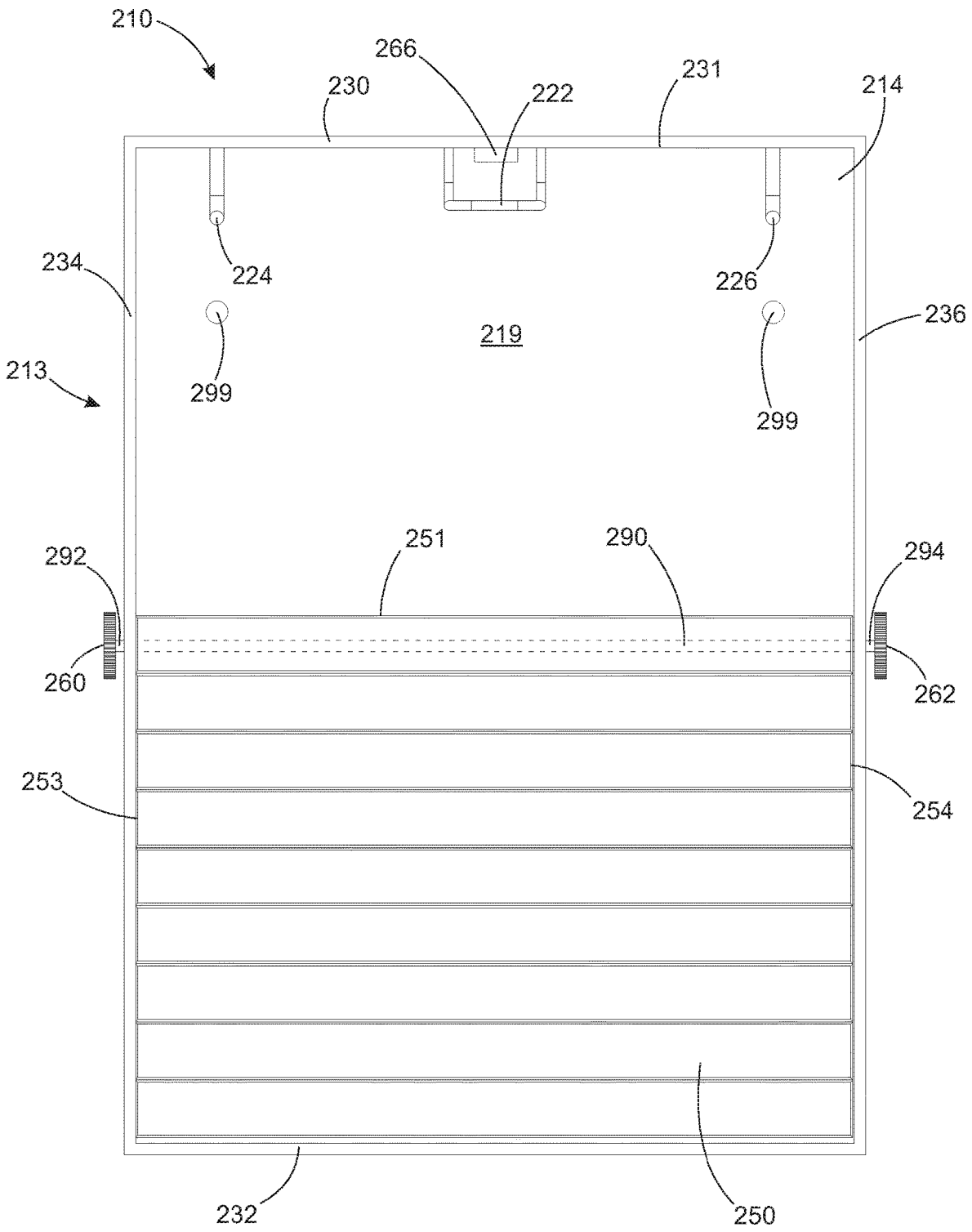
FIG. 7 shows a front view of the bag holder of FIG. 4 with the sliding door partway open.
Figure 8:
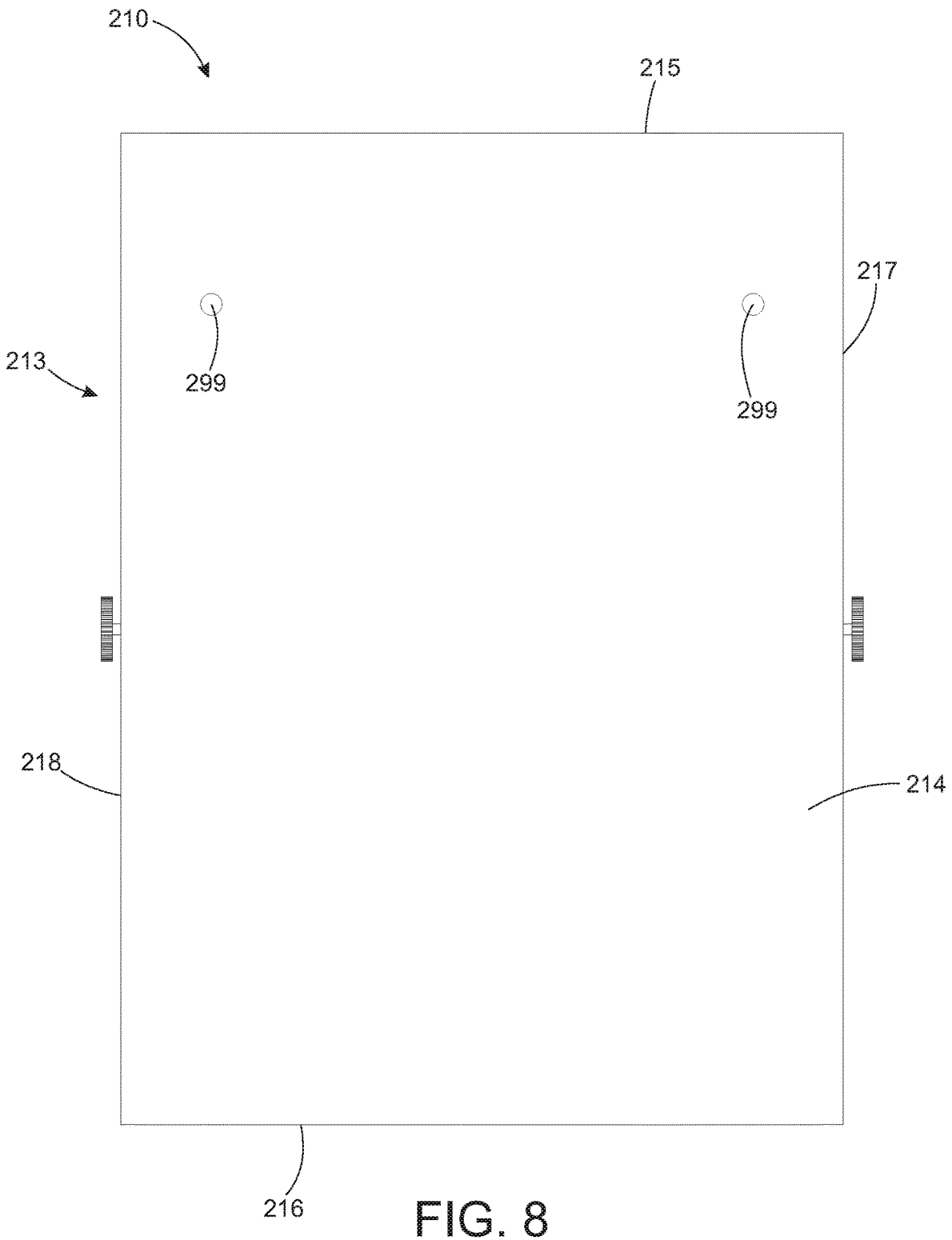
FIG. 8 shows a rear view of the bag holder of FIG. 4.

FIG. 4 through FIG. 8 show details of bag holder 210. FIG. 4 shows a front perspective view of bag holder 210 with sliding door 250 in closed position 244. FIG. 5 shows a bottom perspective view of bag holder 210 with sliding door 250 in open position 242. FIG. 6 shows a side cutaway view of bag holder 210 with sliding door 250 in closed position 244. FIG. 7 shows a front view of bag holder 210 with sliding door 250 in a position partway between open position 242 and closed position 244. FIG. 8 shows a rear view of bag holder 210.

Bag holder 210 is used for holding at least one shopping bag 212. Each bag holder 210 is coupled to center section 203, specifically one of the solid center section side walls 204, 206 and 207. Bag holder 210 holds and dispenses shopping bags 212 at bagging station 208. Bag holder 210 includes a rectangular shaped box 213, sliding door 250, a bag holder hook 222, a first and a second handle holder hook 224 and 226, and a first and a second knob 260 and 262. Bag holder hook 222 and handle holder hooks 224 and 226 are inside of box 213 for hanging shopping bag 212 from. Sliding door 250 is coupled to rectangular box 213 and slides between open position 242 and closed position 244. When sliding door 250 is in open position 242, bag holder 210 holds and dispenses shopping bags 212. When sliding door 250 is in closed position 244, bag holder 210 encases shopping bags 212 and keeps shopping bags 212 secure. Bag holder 210 includes first knob 260 and second knob 262 that are used to open and close sliding door 250.

Rectangular shaped box 213 includes a back plate 214, a top plate 230, a bottom plate 232, a first side plate 234 and a second side plate 236. Back plate 214 is the back of box 213, and top plate 230, bottom plate 232, first side plate 234 and second side plate 236 are the sides of box 213. Rectangular shaped box 213 has an open front 240. Box 213 is rectangular shaped, with top plate 230 coupled to a back plate top edge 215, as shown in FIG. 4 and FIG. 8. Top plate 230 is perpendicular to back plate 214. Bottom plate 232 is coupled to a back plate bottom edge 216, as shown in FIG. 5 and FIG. 8. Bottom plate 232 is perpendicular to back plate 214. First side plate 234 is coupled to a back plate first side edge 217, as shown in FIG. 4 and FIG. 8. First side plate 234 is perpendicular to back plate 214. Second side plate 236 is coupled to a back plate second side edge 218, as shown in FIG. 5 and FIG. 8. Second side plate 236 is perpendicular to back plate 214.

Bag holder 210 includes bag holder hook 222 and two handle holder hooks, first handle holder hook 224 and second handle holder hook 226, as shown in FIG. 2, FIG. 5, FIG. 6, and FIG. 7. Bag holder hook 222 and first and second handle holder hooks 224 and 226 are used to hang at least one shopping bag 212 from, so that shopping bags 212 can be held and dispensed by bag holder hook 222, first handle holder hook 224 and second handle holder hook 226. Shopping bags 212 are usually hung from bag holder hook 222 by their center hole, with each of the two handles hung from either first handle holder hook 224 or second handle holder hook 226, as seen in FIG. 1 and FIG. 2. When sliding door 250 is in open position 242, each shopping bag 212 can be filled with items and then removed from bag holder 210. With shopping bag 212 hung from bag holder hook 222 and first and second hag holder hook 224 and 226, a bag 212 is filled by pulling away the front side of shopping bag 212 from the rear side of shopping bag 212, leaving shopping bag 212 hung from bag holder hook 222 in an open position. Items are placed in shopping bag 212 until shopping bag 212 is full. Shopping bag 212 is then removed from bag holder hook 222 and first and second handle holder hook 224 and 226 to be removed from the retail store. If more items need to be bagged, a new shopping bag 212 is opened, filled, and dispensed.

Bag holder hook 222 and first and second handle holder hooks 224 and 226 are coupled to an inner surface of rectangular shaped box 213 so that shopping bags 212 hung from bag holder hook 222 and first and second handle holder hooks 224 and 226 hang inside of bag holder 210. Bag holder hook 222 and first and second handle holder hooks 224 and 226 are located near top plate 230 of bag holder 210 so that bags 212 hang inside of bag holder 210. Bag holder hook 222 is located about halfway between first and second side plates 234 and 236, with first and second handle holder hooks 224 and 226 on either side of bag holder hook 222, as shown in FIG. 2, FIG. 5, FIG. 6, and FIG. 7. In the embodiment shown in the figures, bag holder hook 222 and first and second handle holder hooks 224 and 226 are coupled to a top plate inner surface 231, as shown in FIG. 5 and FIG. 6, but this is not meant to be limiting. In some embodiments, bag holder hook 222 and first and second handle holder hooks 224 and 226 are coupled to a back plate front surface 219. In some embodiments, bag holder hook 222 and first and second handle holder hooks 224 and 226 are coupled to other inner surfaces of box 213.

Sliding door 250 is coupled to rectangular box 213. Sliding door 250 slides between open position 242, and closed position 244. Sliding door 250 covers open front 240 in closed position 244. Sliding door 250 retracts into box 213 in open position 242, and does not cover open front 240 in open position 242. Sliding door 250 is a flexible tambour- or shutter-type door formed of thin rectangular plates of rigid material flexibly coupled together along their long axes. Sliding door 250 is flexible in a sliding door longitudinal direction 248 (see FIG. 6), and is not flexible in a sliding door latitudinal direction 249 (see FIG. 4). When sliding door 250 is opened, sliding door 250 retracts into rectangular box 213, sliding along back plate front surface 219 (see FIG. 5 and FIG. 7) until sliding door 250 is in open position 242.

Rectangular box 213 includes first knob 260 and second knob 262. First and second knob 260 and 262 are each coupled to a sliding door top edge 251, and are used to move sliding door 250 from closed position 244 to open position 242.

Sliding door 250 has sliding door top edge 251 (FIG. 4 and FIG. 7) a sliding door bottom edge 252 (FIG. 4) a sliding door first side edge 253 and a sliding door second side edge 254. Sliding door 250 has a coupling rod 290 that is coupled to sliding door top edge 251 (FIG. 7) parallel to sliding door latitudinal axis 249. Coupling rod 290 extends along, and is coupled to, sliding door top edge 251 from sliding door first side edge 253 to sliding door second side edge 254. Coupling rod 290 extends out from sliding door first side edge 253 and through a first track slot 270 in first side plate 234, see FIG. 4. First knob 260 is coupled to a coupling rod first end 292 of coupling rod 290, as shown in FIG. 4 and FIG. 7. First knob 260 is outside of rectangular box 213 adjacent a first side plate outer surface 235, see FIG. 4. First knob 260 is used to move sliding door 250 between open position 242 and closed position 244.

Coupling rod 290 extends out from sliding door second side edge 254 and through a second track slot 280 in second side plate 236, see FIG. 5. Second knob 262 is coupled to a coupling rod second end 294 of coupling rod 290, as shown in FIG. 5 and FIG. 7. Second knob 262 is outside of rectangular box 213 adjacent a second side plate outer surface 237, see FIG. 5. Second knob 262 is used to move sliding door 250 between open position 242 and closed position 244

Bag holder 210 includes first track slot 270 and second track slot 280. First and second track slot 270 and 280 are slots in rectangular box 213 that provide a path for coupling rod 290 to move through as sliding door 250 opens and closes. First track slot 270 is an elongate hole through first side plate 234 extending essentially longitudinally through first side plate 234 from a first track slot first end 271 to a first track slot second end 272 that opposes first track slot first end 271, as shown in FIG. 4. Coupling rod 290 extends through first track slot 270 to couple first knob 260 to sliding door 250. Coupling rod 290 slides along first track slot 270 as sliding door 250 opens and closes. First track slot 270 has two sections, a first track slot first section 273, a first track slot second section 275, and a first track slot bend 274. First track slot first section 273 extends from first track slot first end 271 to first track slot bend 274, as shown in FIG. 4. First track slot first section 273 is adjacent a first side plate front edge 277. Coupling rod 290 slides long first track slot first section 273 as sliding door 250 slides from closed position 244 to almost open position, where sliding door top edge 251 is near bottom plate 232. First track slot first section 273 is parallel to sliding door longitudinal axis 248.

First track slot second section 275 extends from first track slot bend 274 to first track slot second end 272, as shown in FIG. 4. First track slot second section 275 is adjacent a first side plate bottom edge 278. Coupling rod 290 slides long first track slot second section 275 as sliding door top edge 251 slides from the almost open position to open position 242, where sliding door top edge 251 is near back plate 214 and sliding door 250 is fully retracted into box 213. In the fully retracted position, which is open position 242, sliding door 250 is laying along back plate front surface 219. First track slot second section 275 is parallel to, and adjacent to, first side plate bottom edge 278.

Second track slot 280 is an elongate hole through second side plate 236 extending essentially longitudinally through second side plate 236 from a second track slot first end 281 to a second track slot second end 282 that opposes second track slot first end 281, as shown in FIG. 5. Coupling rod 290 extends through second track slot 280 to couple second knob 262 to sliding door 250. Coupling rod 290 slides along second track slot 280 as sliding door 250 opens and closes. Second track slot 280 has two sections, a second track slot first section 283, a second track slot second section 285, and a second track slot bend 284. Second track slot first section 283 extends from second track slot first end 281 to second track slot bend 284, as shown in FIG. 5. Second track slot first section 283 is adjacent a second side plate front edge 287. Coupling rod 290 slides long second track slot first section 283 as sliding door top edge 251 slides from closed position 244 to an almost open position, where sliding door top edge 251 is near bottom plate 232. Second track slot first section 283 is parallel to sliding door longitudinal axis 248.

Second track slot second section 285 extends from second track slot bend 284 to second track slot second end 282, as shown in FIG. 5. Second track slot second section 285 is adjacent a second side plate bottom edge 288. Coupling rod 290 slides long second track slot second section 285 as sliding door top edge 251 slides from the almost open position to open position 242, where sliding door top edge 251 is near back plate 214 and sliding door 250 is fully retracted into box 213. In the fully retracted position, which is open position 242, sliding door 250 is laying along back plate front surface 219. Second track slot second section 285 is parallel to, and adjacent to, first side plate bottom edge 288.

Bag holder 210 also includes a first magnet 266 and a second magnet 268, as shown in FIG. 5, FIG. 6, and FIG. 7. First and second magnet 266 and 268 are used to keep sliding door in closed position 244. First magnet 266 is coupled to top side plate inner surface 231, as shown in FIG. 5 and FIG. 6. Second magnet 268 is coupled to sliding door top edge 251, see FIG. 6. Second magnet 268 is coupled to, and moves with, sliding door 250. When sliding door 250 is in closed position 244, second magnet 268 magnetically couples to first magnet 266 to hold sliding door 250 in the closed position, see FIG. 6.

To open sliding door 250, a user grabs one or both of first and second knob 260 or 262, pulls second magnet 268 away from first magnet 266, and slides sliding door 250 open by sliding coupling rod 290 along first and second track 270 and 280. Sliding door 250 slides into open position 242 by sliding along back plate front surface 219 until sliding door 250 is fully retracted into box 213 and first and second knob 260 and 262 and coupling rod 290 are at first and second track second ends 272 and 282, respectively (see FIG. 5). To close sliding door 250, the process is reversed, sliding coupling rod 290 from first and second track second ends 272 and 282 to first and second track first ends 271 and 281 (FIG. 4), and coupling second magnet 268 to first magnet 266 (FIG. 6). In some embodiments, bag holder 210 includes a lock to lock sliding door 251 in the closed position and make bag holder 210 more secure.

A bagging station with a bag holder has been shown and described. The bag holder is a box that encloses a bag dispenser. The bag dispenser includes a bag holder hook and two handle holder hooks. The bag holder is mounted at the bagging station in a retail store so the bag dispenser can hold and dispense shopping bags. The bag holder includes a rectangular box with a sliding door front that encases the bag dispenser and the shopping bags. The sliding door slides between a closed position and an open position. In the open position, the bag dispenser is accessible at the bagging station and is used to dispense shopping bags. In the closed position, the bag dispenser and the shopping bags are enclosed in the bag holder. In the closed position, the shopping bags will not fall off the bag dispenser, or be stolen from the bag dispenser.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above.

The invention claimed is:

1. A bagging station for a retail store comprising:

at least one shopping bag;

a center section configured to sit on a rotating platform; and a bag holder for holding the at least one shopping bag, wherein the bag holder couples to the center section, and wherein the bag holder comprises:

a rectangular shaped box comprising:

a back plate;

a top plate coupled to a back plate top edge;

a bottom plate coupled to a back plate bottom edge;

a first side plate coupled to a back plate first side edge;

a second side plate coupled to a back plate second side edge; and an open front;

a bag holder hook and two handle holder hooks coupled to an inner surface of the rectangular shaped box, wherein the at least one shopping bag is hung from the bag holder hook;

a sliding door coupled to the rectangular shaped box, wherein the sliding door slides between an open position and a closed position, and wherein the sliding door covers the open front when the sliding door is in the closed position, and wherein the sliding door does not cover the open front when the sliding door is in the open position;

a first knob coupled to a sliding door top edge; and a second knob coupled to the sliding door top edge.

2. The bagging station of claim 1, wherein the center section is triangular shaped having three solid center section side walls, and wherein the back plate is coupled to a first center section side wall.

3. The bagging station of claim 1, wherein the sliding door retracts inside the rectangular shaped box.

4. The bagging station of claim 1, wherein the first knob is outside the rectangular shaped box adjacent a first side plate outer surface.

5. The bagging station of claim 4, wherein the second knob is outside the rectangular shaped box adjacent a second side plate outer surface.

6. The bagging station of claim 5, wherein the bag holder further comprises:

a first track slot, wherein the first track slot is an elongate hole through the first side plate extending from a first track slot first end to a first track slot second end; and a coupling rod coupled to the sliding door top edge, wherein the coupling rod extends through the first track slot, and wherein the coupling rod has a coupling rod first end coupled to the first knob, and a coupling rod second end coupled to the second knob.

7. The bagging station of claim 6, wherein the first track slot further comprises:

a first track slot first section;

a first track slot bend; and a first track slot second section;

wherein the first track slot first section extends from the first track slot first end to the first track slot bend adjacent a first side plate front edge; and wherein the first track slot second section extends from the first track slot bend to the first track slot second end adjacent a first side plate bottom edge.

8. The bagging station of claim 7, further comprising a second track slot, wherein the second track slot is an elongate hole through the second side plate extending from a second track slot first end to a second track slot second end; wherein the coupling rod extends through the second track slot.

9. The bagging station of claim 1, wherein two bag holders are coupled to each of the three solid center section side walls.

10. The bagging station of claim 1, wherein the bag holder hook and the two handle holder hooks are coupled to a top plate inner surface.

11. The bagging station of claim 1, wherein the bag holder hook and the two handle holder hooks are coupled to a back plate front surface.

12. The bagging station of claim 1, wherein the at least one shopping bag is hung from the bag holder hook and the first and second handle holder hooks.

13. The bagging station of claim 1, wherein the sliding door slides along a back plate front surface when the sliding door is in the open position.

14. The bagging station of claim 1, wherein the sliding door is flexible in a sliding door longitudinal axis, and wherein the sliding door is rigid along a sliding door latitudinal axis.

15. The bagging station of claim 1, wherein the bag holder further comprises a first and a second magnet.

16. The bagging station of claim 15, wherein the first magnet is coupled to a top plate inner surface.

17. The bagging station of claim 16, wherein the second magnet is coupled to a sliding door top edge.

* * * * *